United States Patent [19]

Anderson

[11] 4,362,916

[45] Dec. 7, 1982

[54] MINIATURE PRECISION SNAP ACTION SWITCH HAVING OPERATING LEVER PROVIDING LARGE OVERTRAVEL

[75] Inventor: Harry B. Anderson, Bradenton, Fla.

[73] Assignee: Eaton Corporation, Cleveland, Ohio

[21] Appl. No.: 305,005

[22] Filed: Sep. 23, 1981

[51] Int. Cl.[3] ..... H01H 3/04

[52] U.S. Cl. ..... 200/153 T; 200/153 LB; 200/332

[58] Field of Search ..... 200/153 T, 332, 335, 200/153 L, 153 LB

[56] References Cited

U.S. PATENT DOCUMENTS

| | | | |
|---|---|---|---|
| 2,454,341 | 11/1948 | Repka | 200/332 X |
| 2,511,271 | 6/1950 | Kaminky et al. | 200/153 T |
| 2,648,234 | 8/1953 | Lester | 200/153 T X |
| 2,817,725 | 12/1957 | Rochfort et al. | 200/47 |
| 2,828,373 | 3/1958 | Sweger | 200/153 T X |
| 3,198,925 | 8/1965 | Starrantino | 200/332 |
| 3,398,248 | 8/1968 | Klauss | 200/153 L |
| 3,755,657 | 8/1973 | Kunz | 200/153 T X |
| 3,774,000 | 11/1973 | Beer | 200/153 T X |
| 3,846,597 | 11/1974 | Ziegler, Jr. | 200/153 LB X |
| 3,928,739 | 12/1975 | Miyamae | 200/153 T X |
| 3,935,410 | 1/1976 | Howard | 200/332 |
| 4,063,056 | 12/1977 | Baker | 200/332 |
| 4,295,017 | 10/1981 | Kashima et al. | 200/153 T X |

FOREIGN PATENT DOCUMENTS

| | | | |
|---|---|---|---|
| 1966546 | 1/1969 | Fed. Rep. of Germany | 200/332 |
| 922312 | 12/1960 | United Kingdom | 200/332 |

*Primary Examiner*—John W. Shepperd
*Assistant Examiner*—Ernest G. Cusick
*Attorney, Agent, or Firm*—C. H. Grace; F. M. Sajovec

[57] ABSTRACT

A large overtravel operating lever for a plunger (6) actuated miniature precision snap action switch (2) that includes a supporting bracket (8) having a cantilever strip (8*c*) extending over the plunger (6). A pivot (10) couples a lever arm (12) to the end of the cantilever strip above the plunger. A cam strip (16) is riveted to the lever arm (12) and extends between the plunger and the pivot and is formed with a nib (16*c*) for depressing the plunger and a constant radius contour (16*b*) leading from the nib for large overtravel of the lever arm. The cam strip (16) extends through a hole (8*h*) in the cantilever strip for clearance on movement and a stop (16*e*) abuts the latter to limit counterclockwise rotation of the lever arm to off position. A metal strip (18) riveted to the bracket extends across the plunger to prevent wear.

12 Claims, 4 Drawing Figures

MINIATURE PRECISION SNAP ACTION SWITCH HAVING OPERATING LEVER PROVIDING LARGE OVERTRAVEL

BACKGROUND OF THE INVENTION

Electric switch operators providing enhanced overtravel have been known heretofore. For example, O. H. Kaminky et al., U.S. Pat. No. 2,511,271, dated June 13, 1950 shows a switch operator having a first spring biased member providing pretravel and a second slidable spring biased member together with the first member providing for operating the switch and overtravel when the operating lever is moved beyond the closing point of the switch. These members and springs are concentrically arranged as shown in FIG. 1 of the patent. Also J. D. Rochfort et al., U.S. Pat. No. 2,817,725, dated Dec. 24, 1957, shows a switch having an operating mechanism providing for overtravel. This operating mechanism includes two levers in generally parallel arrangement and mounted on a common pivot at one end and being hooked together at their opposite ends to prevent the two levers from separating from one another. The first spring biases the switch operating lever away from the switch plunger. A second stronger spring biases the overtravel lever away from the switch operating lever. Therefore, when the switch is operated the switch operating lever initially depresses the switch plunger to actuate the switch. Thereafter, the stronger spring is depressed as the overtravel lever moves down toward the switch operating lever to take up overtravel.

While these prior art overtravel mechanisms have been useful for their intended purpose, nevertheless, they are handicapped by not being able to provide enough or the large degree of overtravel that is required in some applications. This invention relates to improvements thereover.

SUMMARY OF THE INVENTION

An object of the invention is to provide a miniature precision snap action switch with an operating lever providing large overtravel.

A more specific object of the invention is to provide a miniature switch of the plunger actuator type with an operating lever affording a much larger amount of overtravel.

Another specific object of the invention is to provide an operating lever of the aforementioned type having means for adjusting the operating point of the switch.

Another specific object of the invention is to provide a miniature plunger actuated switch with a spring biased rotary cam type operating lever that affords a large amount of overtravel.

Another specific object of the invention is to provide a switch operating lever that affords a large amount of overtravel and is simple in construction and economical to manufacture.

Other objects and advantages of the invention will hereinafter appear.

DESCRIPTION OF THE PREFERRED EMBODIMENT

Figure 1:
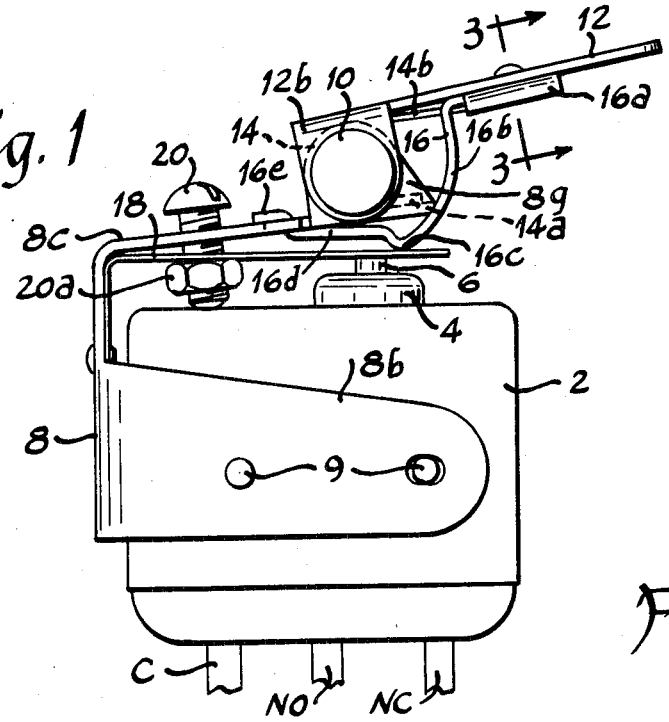
FIG. 1 is an enlarged side elevational view of a miniature precision snap action switch having operating lever providing large overtravel constructed in accordance with the invention.

Referring to FIG. 1 there is shown a miniature precision snap action switch having a large overtravel type operating lever mounted thereon. As shown therein, the switch is provided with an insulating housing 2 having a short upstanding bushing 4 at the top thereof through which extends a switch operating plunger 6. A plurality of terminals or wire connectors extend down through the bottom of housing 2 for connecting the switch to an external circuit, these connectors including a common C, a normally-open NO and a normally-closed NC connector. As will be apparent, when the switch is unactuated the common connector is connected through the contacts to the normally-closed connector and when the switch is actuated the common is disconnected from the normally-closed connector and switched to the normally-open connector.

Figure 2:
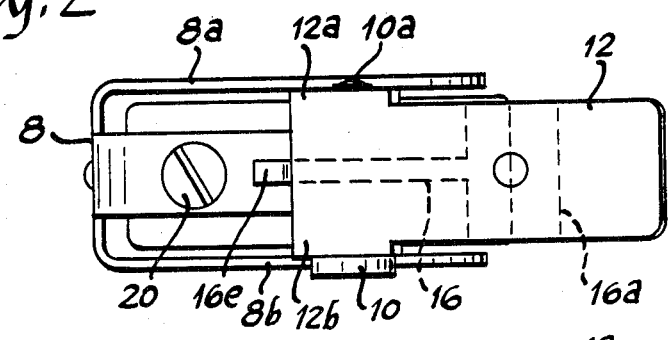
FIG. 2 is a top view of the switch of FIG. 1.
Figure 4:
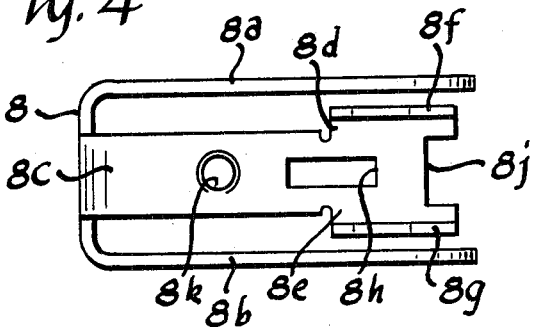
FIG. 4 is a top view of the operating lever mounting bracket used in the switch of FIG. 1.

Switch operating lever mounting bracket 8 has a pair of arms **8*a* and 8*b* that embrace the switch housing as shown in FIGS. 1 and 2 and are secured thereto by bolts, screws 9 or the like. From the yoke between these arms an integral cantilever strip 8*c* extends upwardly above the switch housing and is bent over to the right to overlie switch plunger 6 at an appropriate angle such as 5–7 degrees, for example, and spaced thereabove. As shown in FIG. 4, this bent over strip portion 8*c* terminates at its end in a pair of lateral wings 8*d* and 8*e* that are bent upwardly in parallel relation to form a pair of upstanding ears 8*f* and 8*g*. Holes through these upstanding ears on a common axis as indicated by dotted lines in FIG. 4 receive a pivot pin 10 to pivotally mount operating lever arm 12 to the mounting bracket as shown in FIGS. 1 and 2**.

Figure 3:
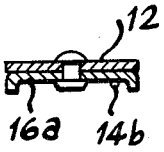
FIG. 3 is a cross sectional view taken substantially along line 3—3 of FIG. 1 to show the configurations of the lever arm and the cam at the point where they are riveted together.

As shown in FIGS. 1 and 2, lever arm 12 has at one end a pair of lateral but downwardly bent tabs **12*a* and 12*b* that embrace the ears of the mounting bracket. One of these tabs 12*b* has a hole coextensive with the holes in the ears of the mounting bracket while the other tab 12*a* has a smaller hole to receive the reduced end portion 10*a* of pivot pin 10. This reduced end portion 10*a* of pivot pin 10 is riveted or peened over to secure the lever arm pivotally to the mounting bracket. A helical return bias spring 14 surrounds pivot pin 10 between upstanding ears 8*f* and 8*g* of the mounting bracket. One end 14*a* of this bias spring bears against the mounting bracket and the other end 14*b* thereof is held in stress against the riveted end of cam 16 to bias lever arm 12 and cam 16 assembly counterclockwise until tip 16*e* stops against the upper surface of strip 8*c* beyond the left end of slot 8*h*. As shown in FIG. 2 in dotted lines, cam 16 is a narrow strip throughout most of its length and has a wide section 16*a* through which it is riveted to lever arm 12. As shown in FIGS. 1 and 3, the ends of the wings of this wide section 16*a* are bent downwardly for retaining the end 14*b* of bias spring 14 from slipping off to one side. From this wide section the narrow strip portion of cam 16 extends downwardly and left as shown in FIG. 1 at a constant radius to provide a cam section 16*b* that continues to a nib 16*c* near the switch plunger. From this nib portion this narrow cam strip is bent angularly upwardly and left and then horizontally to the left at portion 16***d* terminating in an upwardly off-set end portion 16*e* that projects up through and beyond a narrow slot 8*h* in mounting bracket 8. This slot 8*h* is elongated as shown in FIG. 4 to permit portion 16*d* of the cam to slide up there-through as the lever arm is actuated. To prevent wear on plunger 6 and cam 16 as the switch is operated, a thin flat spring strip 18 of stainless steel or the like is riveted to the mounting bracket 8 and underlies bent over stip 8*c* of the mounting bracket and extends over plunger 6 and between plunger 6 and cam 16*c*. Thus, when the switch is operated, cam portion 16*b* and 16*c* slide on this spring strip 18 to prevent any abrasion or wear on plunger 6.

The extreme end portion of mounting bracket strip 8*c* is provided with a slot 8*j* as shown in FIG. 4 to provide clearance for cam portion 16*b*, when the operating lever arm is actuated.

This mounting bracket strip 8*c* is also provided with a threaded hole 8*k* therethrough for receiving an adjusting screw as shown in FIG. 1. This adjusting screw 20 extends also with clearance through a hole in spring strip 18 and has a locking nut 20*a* threaded at its lower end. This locking nut 20*a*, or some equivalent means such as sealing cement or the like, may be used to lock the screw in its adjusted position.

As shown in FIG. 1, the lower end of this adjusting screw 20 abuts the upper surface of the switch housing. Therefore, when the screw is turned in or out strip 8*c* of the mounting bracket will be raised or lowered, respectively, with respect to switch plunger 6. When strip 8*c* of the bracket is raised with respect to the switch plunger this will delay the actuation of the switch contact with respect to lever arm movement. On the other hand, when the screw is turned so that strip 8*c* of the mounting bracket is lowered with respect to plunger 6 under self-tension, this will advance the actuation of the switch contact relative to operating lever arm movement.

In operation when an object comes along and engages lever arm 12 and pivots it clockwise in FIG. 1, nib 16*c* of cam 16 will slide along spring strip 18 down and to the left, rotating on the axis of pivot pin 10, to depress plunger 6 and actuate the switch contacts at a pretravel point in lever arm movement according to the setting of screw 20. After nib 16*c* passes to the left of plunger 6, the lever arm may be moved in overtravel a large amount while the radius of cam 16*b* slides over strip 18 without further depression of the switch plunger. By this means, the overtravel can be increased from a range of about 0.003–0.010 inch in the prior art to as much as 0.400 inch.

While the apparatus hereinbefore described is effectively adapted to fulfill the objects stated, it is to be understood that the invention is not intended to be confined to the particular preferred embodiment of miniature precision snap action switch having operating lever providing large overtravel disclosed, inasmuch as it is susceptible of various modifications without departing from the scope of the appended claims.

I claim:

1. In a miniature switch having a housing enclosing switch contacts and an actuating element extending through the housing for movement to actuate the switch contacts, the improvement comprising:

operating means providing large overtravel comprising;

a mounting bracket secured to said switch housing;

support means on said mounting bracket extending from one side of said housing above and beyond said actuating element;

a pivot on said support means substantially over said actuating element;

an operating lever secured to said pivot for pivotal movement and having a cam member extending generally between said support means and said actuating element;

said cam member comprising a nib for moving said actuating element to actuate the switch contacts and a cam extending from said nib having a constant radius relative to said pivot to provide for large overtravel when said operating lever is pivoted in the turn-on-direction;

and means for biasing said operating lever in the turn-off direction.

2. The improvement claimed in claim 1, wherein:

said operating means comprises a stop on said support means for engagement by said cam member for limiting the turn-off pivotal movement of said operating lever.

3. The improvement claimed in claim 1, wherein:

said operating means comprises means for adjusting the pretravel of said operating lever.

4. The improvement claimed in claim 3, wherein said means for adjusting the pretravel comprises:

a screw threaded in said support means and abutting the switch housing to adjust the level of said pivot relative to said actuating element;

and means for locking said screw in its adjusted position.

5. The improvement claimed in claim 4, wherein:

said means for locking said screw comprises a jamb nut threaded on said screw below said support means.

6. The improvement claimed in claim 1, wherein said operating means comprises a flat metal strip secured to said mounting bracket and extending over said actuating element for engagement by said cam member to protect said actuating element from wear.

7. The improvement claimed in claim 1, wherein said pivot comprises:

a pair of upstanding ears on said support means;

holes through said ears;

and a pivot pin extending through said holes.

8. The improvement claimed in claim 7, wherein said operating lever comprises:

a pair of tabs depending from one end portion thereof;

and holes through said tabs through which said pivot pin extends to pivot said operating lever on said support means.

9. The improvement claimed in claim 8, wherein said means for biasing said operating lever comprises:

a helical spring around said pivot pin and having its ends stressed between said support means and said operating lever to bias the latter to its turn-off position.

10. In a miniature precision snap action switch having a housing enclosing the switch contacts and a plunger extending through a hole in the housing for depression to actuate the switch contacts, the improvement comprising:

an operating mechanism providing large overtravel comprising:

a mounting bracket secured to said housing;

a support strip on said mounting bracket extending above said plunger in spaced relation thereto;

a return spring-biased lever arm pivoted on said support strip above said plunger;

a cam strip extending from the midportion of said lever arm across said plunger;

said cam strip comprising an actuating portion for depressing said plunger when said lever arm is pivoted a predetermined amount and a contour of constant radius relative to said pivot extending from said actuating portion for maintaining said plunger depressed as said lever arm is pivoted further thereby to provide large overtravel;

and a stop on the end of said cam strip for engaging said support strip to limit return movement of said lever arm in the switch-off-position.

11. The improvement claimed in claim 10, wherein:

said support strip has an elongated slot therethrough;

said cam strip rises up through said slot when said lever arm is pivoted;

and said stop comprises an offset portion on the end of said cam strip extending through said slot so as to stop against said support strip at one end of said slot when said lever arm is returned to switch-off position.

12. The improvement claimed in claim 10, wherein:

said operating mechanism also comprises:

an adjusting screw threaded in said support strip to abut said housing for setting the pretravel of said lever arm.

* * * * *